United States Patent [19]

Rota

[11] Patent Number: 4,824,028

[45] Date of Patent: Apr. 25, 1989

[54] SHREDDING PROCESS AND APPARATUS FOR CARRYING OUT SAID PROCESS

[75] Inventor: Fabio Rota, Milan, Italy

[73] Assignee: Satrind S.r.l., Cornaredo, Italy

[21] Appl. No.: 140,754

[22] Filed: Jan. 4, 1988

[30] Foreign Application Priority Data

Jan. 2, 1987 [IT] Italy ..... 20402 B/87

[51] Int. Cl.[4] ..... B02C 4/08

[52] U.S. Cl. ..... 241/24; 241/74; 241/80; 241/236; 241/DIG. 30

[58] Field of Search ..... 241/74, 236, 80, 97, 241/DIG. 30, 24; 209/406, 412, 370, 283, 281, 24

[56] References Cited

U.S. PATENT DOCUMENTS 3,931,935 1/1976 Holman ..... 241/74 X 4,662,893 5/1987 McIntosh ..... 241/74 X

FOREIGN PATENT DOCUMENTS 918360 9/1954 Fed. Rep. of Germany ..... 241/74

*Primary Examiner*—Mark Rosenbaum

*Attorney, Agent, or Firm*—Young & Thompson

[57] ABSTRACT

A shredder (1) is surrounded by a revolving screen (3) which also acts as an elevator. Said shredder outputs the shredded material in the interior of said screen (3), which allows the exit of the smaller material through the holes and lifts the remaining material depositing it once more at the input of the shredder (1). According to the present invention the bottom surface of the drum faces a fixed wall (8) placed at such a distance that it determines the third dimension of the material which passes through.

9 Claims, 1 Drawing Sheet

SHREDDING PROCESS AND APPARATUS FOR CARRYING OUT SAID PROCESS

The present invention concerns a device for shredding materials such as paper, plastics, rubber, wood, thin sheet material and generally any refuse or scrap material, in order to prepare it for destruction or recycling.

Currently existing shredders consist of two series of circular blades, preferably serrated, which rotate around parallel axes following an intersecting path. In these shredders the size of the pieces is determined by the space between blades of the same series mounted on an axis. This space defines only one dimension; however, it therefore guarantees one dimension only, so that in the case of raw material in sheets, it produces strips the length of which cannot be predetermined. Until now, it has been necessary to install two shredders one after the other in order to make shredding into small pieces more likely. This means, however, that shredding is still left to chance and there is no certainty of a uniform result. This sort of arrangement is also decidely costly, since two machines must be used, with double the total power.

Another possibility is that offered by U.S. Pat. No. 3,931,935 in which the shredder is surrounded by a revolving screen which also acts as an elevator. In this way the shredded material drops into the screen which in turn allows the smaller shredded material to pass while bringing the rest back to the input of the shredder. Unfortunately, this system does not ensure a uniform shredding in all directions, since the screen distinguishes only two dimensions. Thus long strips frequently produced by the rotating blades of a shredder may pass through the holes. This happens particularly with stiffer materials.

The aim of the present invention is to guarantee the required size of the final output at a reasonable cost. There would be no point in recycling material if the equipment used to do so involved higher costs than purchase of the raw materials.

The aim has been achieved by enclosing a bladed shredder in a perforated drum with lifting blades.

Figure 1:
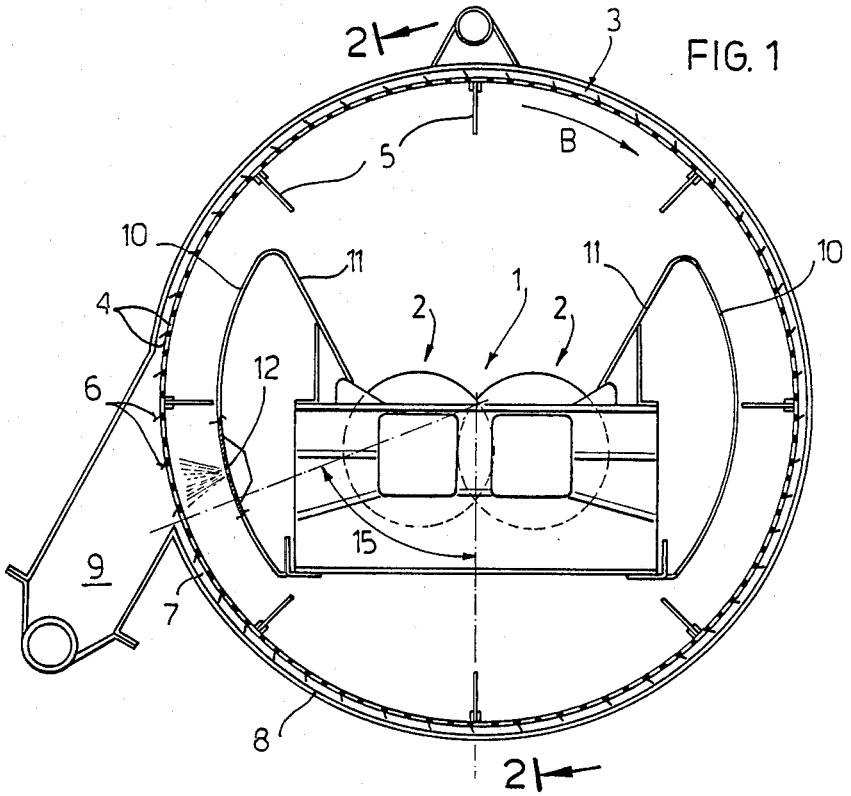
Figure 1A:
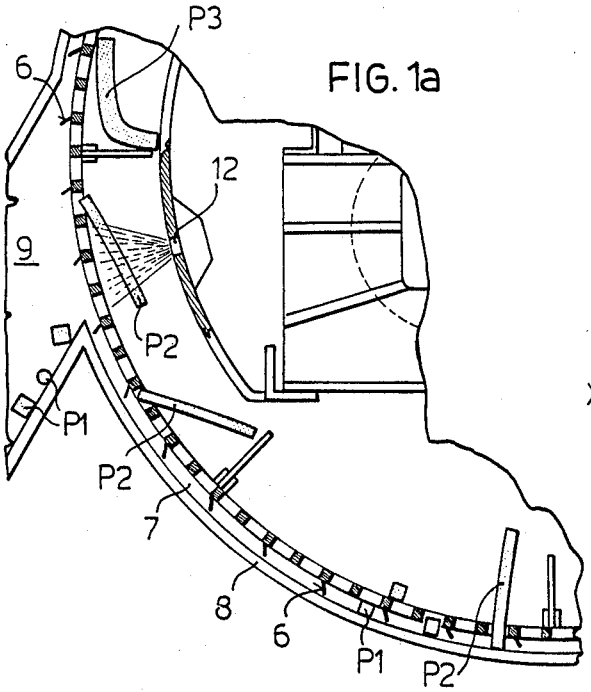
Figure 2:
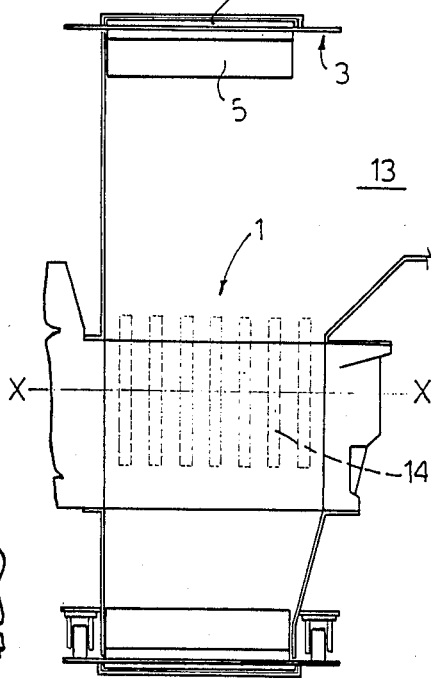

A preferred embodiment of the present invention is shown in the attached drawings, in which:

FIG. 1 shows a cross section of a shredder enclosed in a perforated drum in accordance with the invention;

FIG. 1*a* show an enlarged detail of FIG. 1;

FIG. 2 shows a longitudinal section along the line 2—2 of FIG. 1.

The figures illustrate a shredder indicated as a whole by 1. It consists of two series 2 of circular and/or serrated intersecting blades. This shredder is enclosed in a drum or sieve 3, which rotates in the direction of the arrow B and has holes 4 of such a size so as to define the two transversal dimensions of the pieces. The drum 3 has rubber blades 5 on the inside so as to lift the pieces which must be broken into smaller pieces and carried back to the input of the machine.

The drum 3 is also provided with external scoops or blades 6 for sorting material coming out of the machine. Zone 7 denotes an area between the drum 3 and a surface 8 which face said drum 3 at least for the period during which the machine empties through the holes 4.

Also provided are conductors or guides 10 that stop the pieces from dropping before reaching the shredder 1. The guides 10 also have a slide 11 which acts as a conveyor. Finally provided are nozzles 12 that can be used to squirt fluids at high pressure.

The device works as follows:

The shredder 1 receives the material to be cut up at the entrance 13, passes it through the blades 14 and lets it drop into the drum 3. The larger pieces P3 that need more shredding are collected by the rubber blades 5. The shredded material P2 which has at least two dimensions smaller than the holes 4, passes through the drum 3. These pieces, however, cannot exit completely and are lifted by the rotation of the drum and by the action of the blades 6 towards outlet 9, which is placed sideways to the drum 3, that is at a higher point than the bottom of the drum 3. The outlet allows dumping of the pieces only to take place in a corner 15 with a vertical side, the angle of the corner being 50° to 70°.

Reaching outlet 9, the pieces P1 that are smaller than the holes in the drum 3*a* and the space 7 are moved away from the drum 3 and are fed through outlet 9; the pieces P2 that because of their length have their center of gravity in the interior of the drum 3 fall of their own weight into the interior of said drum 3.

It is also possible to adjust the space 7. Even the angle 15 can be altered.

I claim:

1. An apparatus for shredding shreddable material comprising:

a perforated rotating screening drum having a horizontal or inclined longitudinal axis, said screening drum including inwardly extending blades, shredding means positioned within said drum comprising two rows of rotating intermeshing cutting blades, said rows of blades being aligned substantially parallel to the longitudinal axis of said drum, a fixed outer wall surrounding at least a lower portion of said perforated screening drum, said screening drum and said fixed outer wall defining therebetween an annular space, and an outlet in said fixed outer wall for the recovery of shredded material which passes through said perforated rotating screening drum, said outlet communicating with said annular space and positioned above the lowermost portion of said annular space.

2. The apparatus of claim 1 wherein said perforated rotating screening drum further includes blades extending into said annular space from an outer circumferential surface thereof.

3. The apparatus of claim 1 wherein said inwardly extending blades are comprised of rubber.

4. The apparatus of claim 1 wherein said outlet is tubular in configuration and includes a longitudinal axis which intersects a vertical plane at an angle of between 50° and 70°.

5. The apparatus of claim 1 wherein the width of said annular space is substantially the same as the maximum dimension of the perforations in said screening drum.

6. The apparatus of claim 1 wherein said fixed wall entirely surrounds said screening drum.

7. The apparatus of claim 1 further including guide means to direct shreddable material to said blades which material cannot pass through said perforated drum.

8. The apparatus of claim 1 further including means to direct pressurized fluid outwardly through said perforated drum toward said outlet to assist in the recovery of shredded material which has passed through said drum.

9. A method for shredding shreddable material comprising the steps of shredding said shreddable material in shredding means including two rows of rotating intermeshing cutting blades, said rotating intermeshing blades being positioned within a perforated rotating screening drum having a horizontal or inclined longitudinal axis with said screening drum having inwardly extending blades, collecting shredded material which passes through perforations in said screening drum in an annular space between said screening drum and an outer fixed wall which surrounds at least a lower portion of said perforated drum, recovering shredded material collected in said annular space, and recycling for further shredding shredded material which does not pass through said perforations in said screening drum.

* * * * *